US008491072B2

(12) United States Patent
Yamagishi et al.

(10) Patent No.: US 8,491,072 B2
(45) Date of Patent: Jul. 23, 2013

(54) INKJET PRINTING APPARATUS

(75) Inventors: Ryota Yamagishi, Ibaraki-ken (JP); Tomohiko Shimoda, Ibaraki-ken (JP)

(73) Assignee: Riso Kagaku Corporation (JP)

( * ) Notice: Subject to any disclaimer, the term of this patent is extended or adjusted under 35 U.S.C. 154(b) by 155 days.

(21) Appl. No.: 13/221,735

(22) Filed: Aug. 30, 2011

(65) Prior Publication Data

US 2012/0056925 A1 Mar. 8, 2012

(30) Foreign Application Priority Data

Sep. 3, 2010 (JP) ..... 2010-197578

(51) Int. Cl.
*B41J 25/308* (2006.01)
*B41J 29/38* (2006.01)

(52) U.S. Cl.
USPC ..... 347/8; 347/14

(58) Field of Classification Search
USPC ..... 101/474; 271/196, 276, 3.22; 400/635, 400/642; 347/104, 14, 8
See application file for complete search history.

(56) References Cited

U.S. PATENT DOCUMENTS 3,527,166 A * 9/1970 Jaffa et al. ..... 101/474
5,967,510 A * 10/1999 Ono et al. ..... 271/196
6,045,278 A * 4/2000 Kubatzki et al. ..... 400/635
6,425,580 B1 * 7/2002 Yaneda ..... 271/276
6,672,720 B2 * 1/2004 Smith ..... 347/104
7,137,750 B2 * 11/2006 Fujioka et al. ..... 400/642
8,287,120 B2 * 10/2012 Murata et al. ..... 347/104
2007/0127090 A1 6/2007 Nonaka
2010/0084803 A1 * 4/2010 Akihiro et al. ..... 271/3.22

FOREIGN PATENT DOCUMENTS

JP 2007-152644 A 6/2007

* cited by examiner

*Primary Examiner* — Stephen Meier
*Assistant Examiner* — Carlos A Martinez
(74) *Attorney, Agent, or Firm* — Studebaker & Brackett PC

(57) ABSTRACT

An inkjet printing apparatus includes: a conveyer belt with a plurality of belt holes formed therein, the conveyer belt suctioning and conveying a recording medium with a negative pressure acting on the belt holes; a platen with a plurality of through holes formed therein; a pressure-reducing unit for generating the negative pressure on a side of the platen opposite from the side thereof supporting the conveyer belt; inkjet nozzles disposed to face the platen; a distance-changing unit for changing a distance between the inkjet nozzles and a surface of the conveyer belt on which the recording medium is suctioned; and a size-adjusting unit for adjusting, when the distance is large, a size of at least one through hole in a through hole group, which includes the through holes positioned in the vicinity of the inkjet nozzles, such that the size of the at least one through hole is reduced.

8 Claims, 12 Drawing Sheets

INKJET PRINTING APPARATUS

BACKGROUND OF THE INVENTION

1. Field of the Invention

The present invention relates to an inkjet printing apparatus for carrying out printing by ejecting ink on a recording medium, such as a paper sheet.

2. Description of the Related Art

It is conventionally known with inkjet printing apparatuses that, in order to correct for deformed posture of a paper sheet, such as curl or cockling, a number of through holes for generating a suction force are formed in the surface of a platen, and a porous platen belt is provided to slide over the platen to suction and convey the paper sheet with the suction force generated at belt holes.

Japanese Unexamined Patent Publication No. 2007-152644 (hereinafter, Patent Document 1) has proposed an inkjet printing apparatus, wherein a distance between the upper surface of the platen belt and inkjet nozzles provided in the lower surface of an inkjet head (which will hereinafter be referred to as a head gap) is adjusted depending on the thickness of the paper sheet, thereby preventing the paper sheet being suctioned and conveyed by the platen belt from contacting the nozzle surface of the inkjet head and to prevent occurrence of jam caused by the contact between the paper sheet and the nozzle surface of the inkjet head.

In the above-described inkjet printing apparatus, when the belt holes which are not closed with the paper sheet pass above the through holes of the platen, the air above the platen belt is drawn into a space below the platen via the belt holes and the through holes, and streams of air are generated above the platen belt. The range where the streams of air are generated is wider when the head gap is larger, and this may result in disturbed streams of air above the platen belt.

If such disturbed streams of air are generated in the vicinity of the inkjet nozzles, fine ink droplets (which will hereinafter be referred to as "ink mist"), which are formed when the ink is ejected, may be scattered, and the scattered ink mist may adhere on the paper sheet and/or the interior of the apparatus, which results in degradation of printing quality and contamination of the interior of the apparatus.

SUMMARY OF THE INVENTION

In view of the above-described circumstances, the present invention is directed to providing an inkjet printing apparatus, wherein the head gap can be adjusted depending on the thickness of the paper sheet, and the contamination with scattered ink mist can be reduced.

A first aspect of the inkjet printing apparatus of the invention is an inkjet printing apparatus for carrying out printing by ejecting ink on a recording medium, the apparatus including: a conveyer belt with a plurality of belt holes formed therein, the conveyer belt suctioning and conveying the recording medium with a negative pressure acting on the belt holes; a platen with a plurality of through holes formed therein, the platen slidably supporting the conveyer belt; pressure reducing means for generating the negative pressure on a side of the platen opposite from a side thereof supporting the conveyer belt; at least one inkjet nozzle disposed to face the platen, the inkjet nozzle ejecting the ink on the recording medium being conveyed by the conveyer belt; distance changing means for changing a distance (head gap) between a surface of the conveyer belt on which the recording medium is suctioned and the inkjet nozzle; and size adjusting means for adjusting a size of the through holes based on the distance, wherein, when the distance is large, the size adjusting means adjusts the size of at least one through hole in a through hole group such that the size of the at least one through hole is reduced, the through hole group including the through holes positioned upstream in a conveyance direction of the recording medium from and nearest to each position corresponding to the at least one inkjet nozzle in a plan view and the through holes positioned downstream in the conveyance direction from and nearest to each position corresponding to the at least one inkjet nozzle in the plan view.

The through holes positioned nearest to a certain position corresponding to the nozzle in a plan view refers to that, when the platen is viewed from the side of the inkjet nozzle, a distance between an edge of the opening of each through hole nearer to the inkjet nozzle and the certain position corresponding to the inkjet nozzle is the smallest.

The size of the through holes refers to a sectional area of the through holes. In the case where the sectional area of each through hole vary depending on the position of the section, the size of the through hole refers to the smallest sectional area thereof.

In the above-described apparatus, when the distance is large, the size adjusting means may adjust the size of at least a half of the through holes in the through hole group such that the size of the at least half of the through holes is reduced.

Further, the platen may include an upper platen and a lower platen, and the size adjusting means may adjust the size of the through holes by shifting a position of the lower platen relative to the upper platen.

The above-described apparatus may further include position adjusting means for adjusting relative positions of the through holes relative to the inkjet nozzle based on the distance, wherein, when the distance is large, the position adjusting means may adjust the relative position of at least one through hole in the through hole group relative to the inkjet nozzle such that the position of the at least one through hole is shifted away from the inkjet nozzle.

That the position of the through hole is shifted away from the inkjet nozzle in a plan view refers to that, when the platen is viewed from the side of the inkjet nozzle, a distance between the inkjet nozzle and an edge of the opening of the through hole nearer to the inkjet nozzle is increased.

Adjusting the relative position of the through hole relative to the inkjet nozzle refers widely to various manners of adjustment that achieve shift of the positions of the through hole and the inkjet nozzle relative to each other. For example, the relative position may be adjusted by shifting the through hole relative to the inkjet nozzle at a fixed position, by shifting the inkjet nozzle relative to the through hole at a fixed position, or by shifting both the through hole and the inkjet nozzle.

A second aspect of the inkjet printing apparatus of the invention is an inkjet printing apparatus for carrying out printing by ejecting ink on a recording medium, the apparatus including: a conveyer belt with a plurality of belt holes formed therein, the conveyer belt suctioning and conveying the recording medium with a negative pressure acting on the belt holes; a platen with a plurality of through holes formed therein, the platen slidably supporting the conveyer belt; pressure reducing means for generating the negative pressure on a side of the platen opposite from a side thereof supporting the conveyer belt; at least one inkjet nozzle disposed to face the platen, the inkjet nozzle ejecting the ink on the recording medium being conveyed by the conveyer belt; distance changing means for changing a distance between the inkjet nozzle and a surface of the conveyer belt on which the recording medium is suctioned; and position adjusting means for adjusting relative positions of the through holes relative to the inkjet nozzle based on the distance, wherein, when the distance is large, the position adjusting means adjusts the relative position of at least one through hole in a through hole group relative to the inkjet nozzle such that the position of the at least one through hole is shifted away from the inkjet nozzle, the through hole group including the through holes positioned upstream in a conveyance direction of the recording medium from and nearest to each position corresponding to the at least one inkjet nozzle in a plan view and the through holes positioned downstream in the conveyance direction from and nearest to each position corresponding to the at least one inkjet nozzle in the plan view.

In the above-described apparatus, when the distance is large, the position adjusting means may adjust the relative positions of at least a half of the through holes in the through hole group relative to the inkjet nozzle such that the positions of the at least half of through holes are shifted away from the inkjet nozzle.

Further, the platen may include an upper platen and a lower platen, and the position adjusting means may adjust the relative position by shifting the position of the lower platen relative to the upper platen.

A third aspect of the inkjet printing apparatus of the invention is an inkjet printing apparatus for carrying out printing by ejecting ink on a recording medium, the apparatus including: a conveyer belt with a plurality of belt holes formed therein, the conveyer belt suctioning and conveying the recording medium with a suction force generated at the belt holes; a platen with a plurality of through holes formed therein, the platen slidably supporting the conveyer belt; pressure reducing means for generating a negative pressure on a side of the platen opposite from a side thereof supporting the conveyer belt to generate the suction force at the belt holes via the through holes; at least one inkjet nozzle disposed to face the platen, the inkjet nozzle ejecting the ink on the recording medium being conveyed by the conveyer belt; distance adjusting means for adjusting, in a case where the recording medium is an envelope, a distance between the inkjet nozzle and a surface of the conveyer belt on which the recording medium is suctioned such that a larger distance between the inkjet nozzle and the surface of the conveyer belt is provided for a larger width of the envelope in a direction perpendicular to a conveyance direction of the envelope; and opening/closing adjusting means for adjusting, in the case where the recording medium is an envelope and when the distance is large, opening and closing of the through holes such that an area where the suction force is generated has a large width in the direction perpendicular to the conveyance direction.

According to the first aspect of the inkjet printing apparatus of the invention, the apparatus is provided with: a conveyer belt with a plurality of belt holes formed therein, the conveyer belt suctioning and conveying the recording medium with a negative pressure acting on the belt holes; a platen with a plurality of through holes formed therein, the platen slidably supporting the conveyer belt; pressure reducing means for generating the negative pressure on a side of the platen opposite from a side thereof supporting the conveyer belt; at least one inkjet nozzle disposed to face the platen, the inkjet nozzle ejecting the ink on the recording medium being conveyed by the conveyer belt; distance changing means for changing a distance between the inkjet nozzle and a surface of the conveyer belt on which the recording medium is suctioned; and size adjusting means for adjusting a size of the through holes based on the distance, wherein, when the distance is large, the size adjusting means adjusts the size of at least one through hole in a through hole group such that the size of the at least one through hole is reduced, the through hole group including the through holes positioned upstream in a conveyance direction of the recording medium from and nearest to each position corresponding to the at least one inkjet nozzle in a plan view and the through holes positioned downstream in the conveyance direction from and nearest to each position corresponding to the at least one inkjet nozzle in the plan view. Therefore, even when the head gap is large, the suction force in the vicinity of the inkjet nozzle is reduced by reducing the size of the at least one through hole, thereby reducing the disturbance of streams of air in the vicinity of the inkjet nozzle. This can also reduce the contamination with scattered ink mist caused by the disturbance of streams of air in the vicinity of the inkjet nozzle.

In the above-described apparatus, if the size adjusting means adjusts, when the distance is large, the size of at least a half of the through holes in the through hole group such that the size of the at least half of the through holes is reduced, more effective reduction of the contamination with scattered ink mist is achieved.

If the above-described apparatus further includes position adjusting means for adjusting relative positions of the through holes relative to the inkjet nozzle based on the distance, wherein, when the distance is large, the position adjusting means adjusts the relative position of at least one through hole in the through hole group relative to the inkjet nozzle such that the position of the at least one through hole is shifted away from the inkjet nozzle, then, the suction force in the vicinity of the inkjet nozzle is reduced, even when the head gap is large, by shifting the at least one through hole away from the inkjet nozzle, thereby reducing the disturbance of streams of air in the vicinity of the inkjet nozzle. This can also reduce the contamination with scattered ink mist caused by the disturbance of streams of air in the vicinity of the inkjet nozzle.

According to the second aspect of the inkjet printing apparatus of the invention, the apparatus is provided with: a conveyer belt with a plurality of belt holes formed therein, the conveyer belt suctioning and conveying the recording medium with a negative pressure acting on the belt holes; a platen with a plurality of through holes formed therein, the platen slidably supporting the conveyer belt; pressure reducing means for generating the negative pressure on a side of the platen opposite from a side thereof supporting the conveyer belt; at least one inkjet nozzle disposed to face the platen, the inkjet nozzle ejecting the ink on the recording medium being conveyed by the conveyer belt; distance changing means for changing a distance between the inkjet nozzle and a surface of the conveyer belt on which the recording medium is suctioned; and position adjusting means for adjusting relative positions of the through holes relative to the inkjet nozzle based on the distance, wherein, when the distance is large, the position adjusting means adjusts the relative position of at least one through hole in a through hole group relative to the inkjet nozzle such that the position of the at least one through hole is shifted away from the inkjet nozzle, the through hole group including the through holes positioned upstream in a conveyance direction of the recording medium from and nearest to each position corresponding to the at least one inkjet nozzle in a plan view and the through holes positioned downstream in the conveyance direction from and nearest to each position corresponding to the at least one inkjet nozzle in the plan view. Therefore, even when the head gap is large, the suction force in the vicinity of the inkjet nozzle is reduced by shifting the at least one through hole away from the inkjet nozzle, thereby reducing the disturbance of streams of air in the vicinity of the inkjet nozzle. This can also reduce the contamination with scattered ink mist caused by the disturbance of streams of air in the vicinity of the inkjet nozzle.

In the above-described apparatus, if the position adjusting means adjusts, when the distance is large, the positions of at least a half of the through holes in the through hole group relative to the inkjet nozzle such that the positions of the at least half of through holes are shifted away from the inkjet nozzle, more effective reduction of the contamination with scattered ink mist is achieved.

According to the third aspect of the inkjet printing apparatus of the invention, the apparatus is provided with: a conveyer belt with a plurality of belt holes formed therein, the conveyer belt suctioning and conveying the recording medium with a suction force generated at the belt holes; a platen with a plurality of through holes formed therein, the platen slidably supporting the conveyer belt; pressure reducing means for generating a negative pressure on a side of the platen opposite from a side thereof supporting the conveyer belt to generate the suction force at the belt holes via the through holes; at least one inkjet nozzle disposed to face the platen, the inkjet nozzle ejecting the ink on the recording medium being conveyed by the conveyer belt; distance adjusting means for adjusting, in a case where the recording medium is an envelope, a distance between the inkjet nozzle and a surface of the conveyer belt on which the recording medium is suctioned such that a larger distance between the inkjet nozzle and the surface of the conveyer belt is provided for a larger width of the envelope in a direction perpendicular to a conveyance direction of the envelope; and opening/closing adjusting means for adjusting, in the case where the recording medium is an envelope and when the distance is large, opening and closing of the through holes such that an area where the suction force is generated has a large width in the direction perpendicular to the conveyance direction. Therefore, the width of the area on the conveyer belt where the suction force is generated can be appropriately controlled depending on the width of the envelope, thereby reducing the disturbance of streams of air in the vicinity of the inkjet nozzle.

DESCRIPTION OF THE PREFERRED EMBODIMENTS

Figure 1:
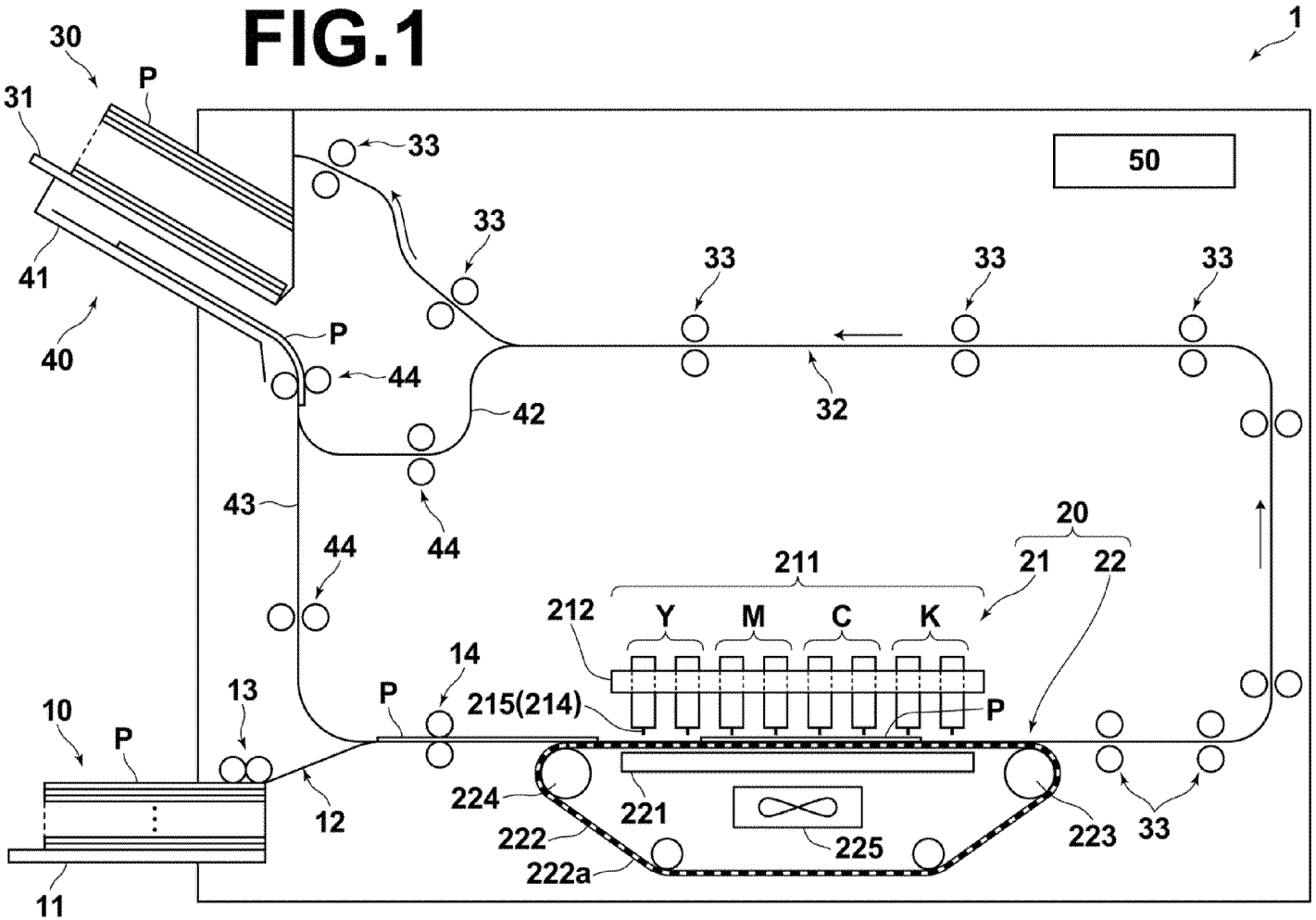
FIG. 1 is a schematic structural diagram of an inkjet printing apparatus.

Now, an embodiment of a first aspect of an inkjet printing apparatus according to the present invention is described with reference to the drawings. FIG. 1 is a schematic structural diagram of an inkjet printing apparatus 1 according to this embodiment. The inkjet printing apparatus 1 includes a paper feed section 10, a printing section 20, a paper discharge section 30, a reversing section 40 and a control section 50.

The paper feed section 10 feeds paper sheets P to the printing section 20. The paper feed section 10 includes: a paper feed tray 11, on which unprinted paper sheets P are stacked, disposed at the lower part of a side surface of the inkjet printing apparatus 1; a paper feed path 12 to guide each paper sheet P from the paper feed tray 11 to the printing section 20; a pair of paper feed rollers 13 to take out the paper sheets P one by one from the paper feed tray 11; and a pair of timing rollers 14 to send each paper sheet P into the printing section 20 at predetermined timing.

The printing section 20 conveys the paper sheet P from the paper feed section 10, ejects ink onto the paper sheet P to effect printing, and conveys the paper sheet P to the paper discharge section 30. The printing section 20 includes a head unit 21 to eject ink, and a platen unit 22 to convey the paper sheet P below the head unit 21. Details about the head unit 21 and the platen unit 22 will be described later.

The paper discharge section 30 conveys and discharges the printed paper sheet P. The paper discharge section 30 includes: a paper discharge tray 31, on which the printed paper sheets P are stacked, disposed at the upper part of the side surface of the inkjet printing apparatus 1; a paper discharge path 32 to guide each printed paper sheet P with the printed surface thereof facing down from the printing section 20 to the paper discharge tray 31; and pairs of paper discharge rollers 33 to send out the paper sheets P on the paper discharge path 32 one by one.

The reversing section 40 once stops the single-side printed paper sheets P and sends each paper sheet P with the unprinted surface thereof facing up again to the printing section 20. The reversing section 40 includes: a buffer space 41 provided on the back side of the paper discharge tray 31; a branching path 42 branching at the middle of the paper discharge path 32 to guide each paper sheet P to the buffer space 41; a paper refeeding path 43 to guide each paper sheet P from the buffer space 41 to the pair of timing rollers 14; and pairs of reversing rollers 44 to send out each paper sheet P on the branching path 42 and the paper refeeding path 43.

The control section 50 controls operations of each section and processes instructions from the user inputted via an operation panel (not shown).

Next, the entire operation of the inkjet printing apparatus 1 is described. An unprinted paper sheet P is taken out from the paper feed tray 11 onto the paper feed path 12 by the pair of paper feed rollers 13. The paper sheet P on the paper feed path 12 is sent to the printing section 20 by the pair of timing rollers 14 at predetermined timing.

In the printing section 20, the platen unit 22 conveys the paper sheet P at a predetermined speed, and the head unit 21 ejects ink onto the paper sheet P to effect printing. The printed paper sheet is sent onto the paper discharge path 32 one by one by the pairs of paper discharge rollers 33, and is guided with the printed surface thereof facing down to the paper discharge tray 31 to be discharged.

In the case where double-side printing is carried out, a path switching mechanism (not shown) disposed at the middle of the paper discharge path 32 sends the paper sheet P on the paper discharge path 32 to the branching path 42 and the paper sheet P is guided to the buffer space 41. Then, the paper sheet P is sent from the buffer space 41 to the paper refeeding path 43, and is again guided to the pair of timing rollers 14 to be refed to the printing section 20. In the following description, a direction perpendicular to the conveyance direction of the paper sheet P is referred to as a main-scanning direction, and the conveyance direction of the paper sheet P is referred to as a sub-scanning direction.

Now, the head unit 21 of the printing section 20 is described. The head unit 21 includes a plurality of inkjet heads 211, and a head holder 212 to hold the inkjet heads 211.

Figure 2:
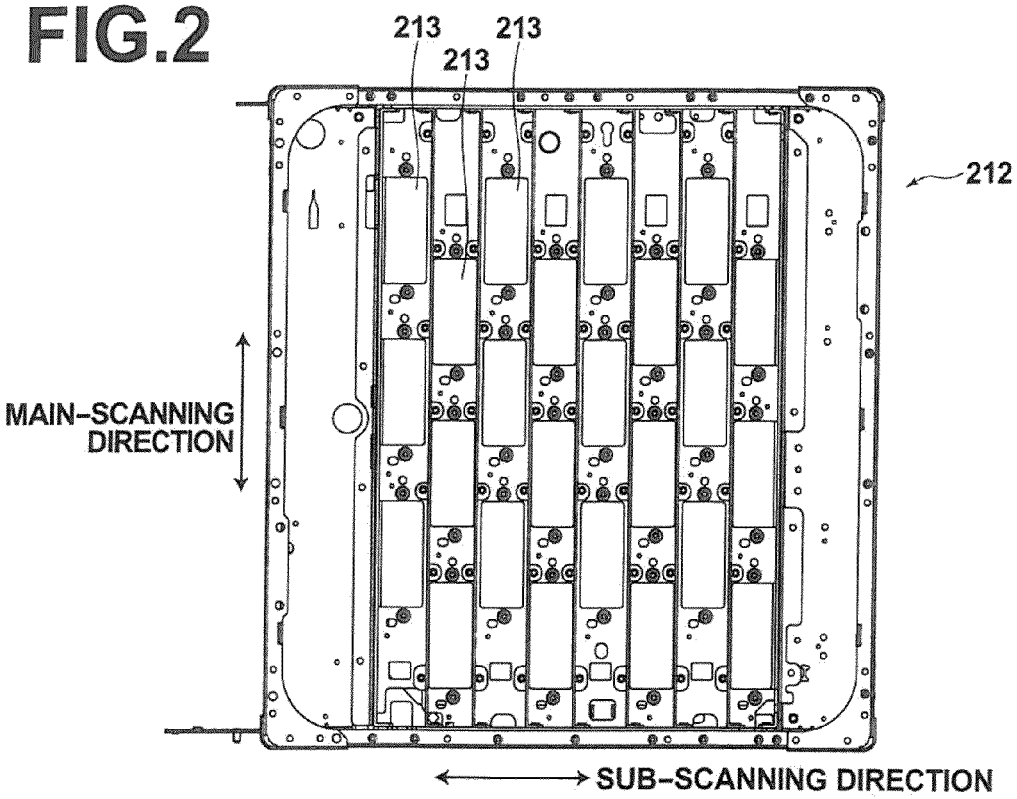
FIG. 2 is a plan view of a head holder.
Figure 3:
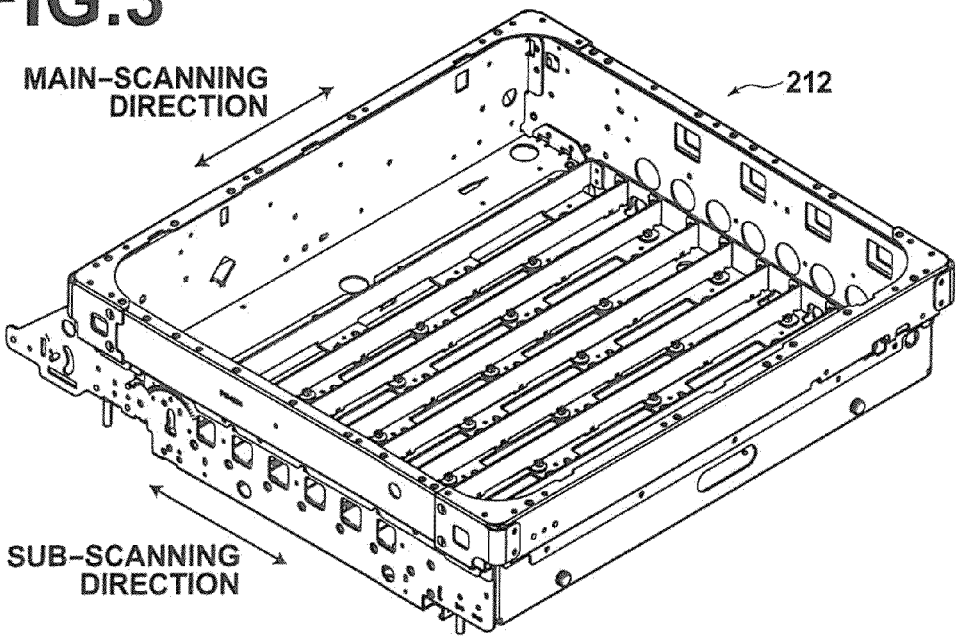
FIG. 3 is a perspective view of the head holder.

FIG. 2 is a plan view of the head holder 212 and FIG. 3 is a perspective view of the head holder 212. As shown in FIGS. 2 and 3, the head holder 212 includes a plurality of attachment holes 213, which are formed in a staggered pattern at predetermined intervals along the main-scanning direction and the sub-scanning direction. The head holder 212 holds the inkjet heads 211, where each inkjet head 211 is inserted into each attachment hole 213 using a flange (not shown), or the like.

Referring again to FIG. 1, each inkjet head 211 includes inkjet nozzles 214, which eject ink toward the paper sheet P. When a voltage is applied to piezoelectric elements to vibrate the piezoelectric elements, the inkjet nozzles 214 eject uniform droplets. The inkjet nozzles 214 are arranged along the scanning direction at the lower surface of the inkjet head 211 to form a linear nozzle array 215. That is, the inkjet nozzles 214 eject ink line by line.

In this embodiment, six inkjet heads 211 which eject ink of the same color are grouped to eject one of colors including black K, magenta M, cyan C and yellow Y.

Now, the platen unit 22 is described. The platen unit 22 includes: a platen 221, which is positioned below the head unit 21 to face each inkjet nozzle 214; an endless platen belt 222 disposed to slide over the platen 221; a driving roller 223 to drive the platen belt 222; a driven roller 224; and a fan 225 to provide a negative pressure in the space below the platen 221.

The platen unit 22 further includes a mechanism for changing the height position of the platen belt 222 with a driving means, such as a motor or a solenoid. The height of the platen belt 222 is controlled by the control section 50. The control section 50 controls the height such that the height of the upper surface of the platen belt 222 relative to the head holder 212 is higher when the paper sheet P is thicker. The control section 50 can change the height of the upper surface of the platen belt 222 in a continuous or stepwise manner. Thus, a larger head gap is set for a thicker paper sheet P. The information of the thus set head gap is stored in a memory (not shown) provided in the inkjet printing apparatus 1. The mechanism for changing the height of the head holder 212, the driving means and the control section 50 form distance changing means of the invention.

Figure 4:
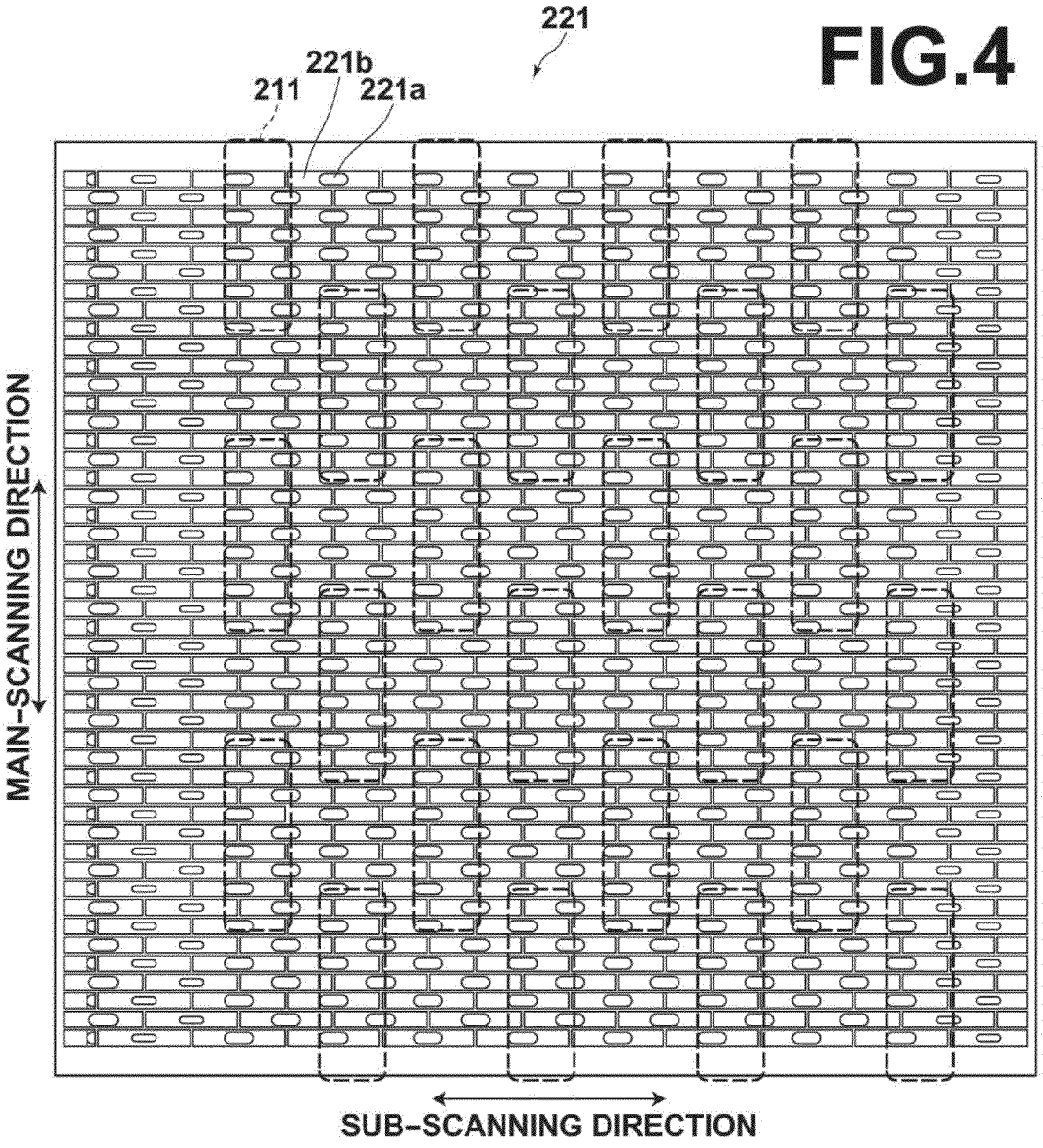
FIG. 4 is a plan view of a platen.
Figure 5:
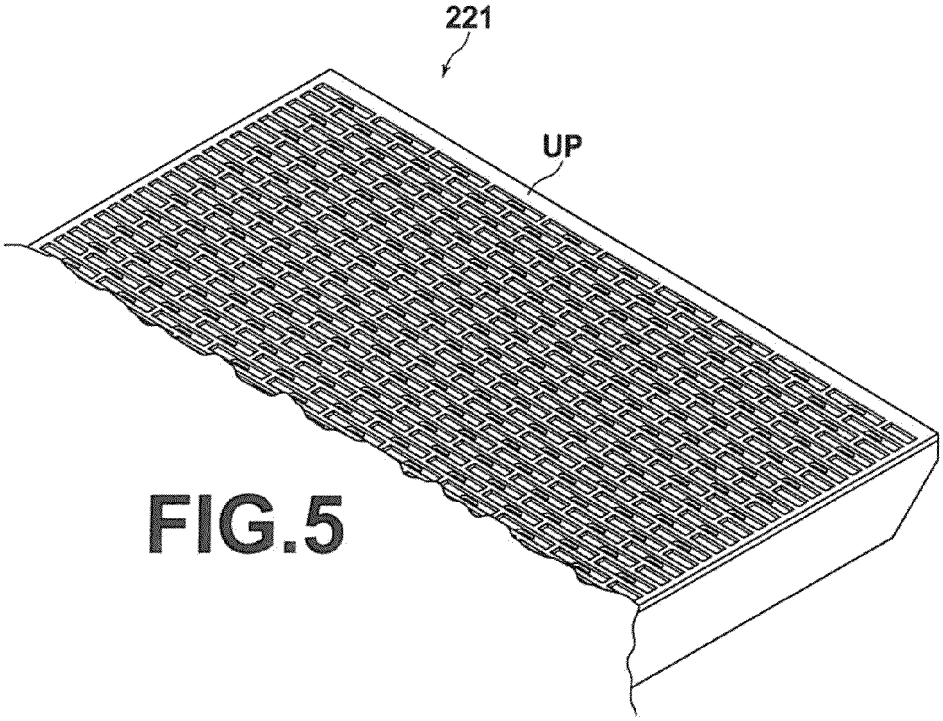
FIG. 5 is a perspective view of the platen viewed from above.
Figure 6:
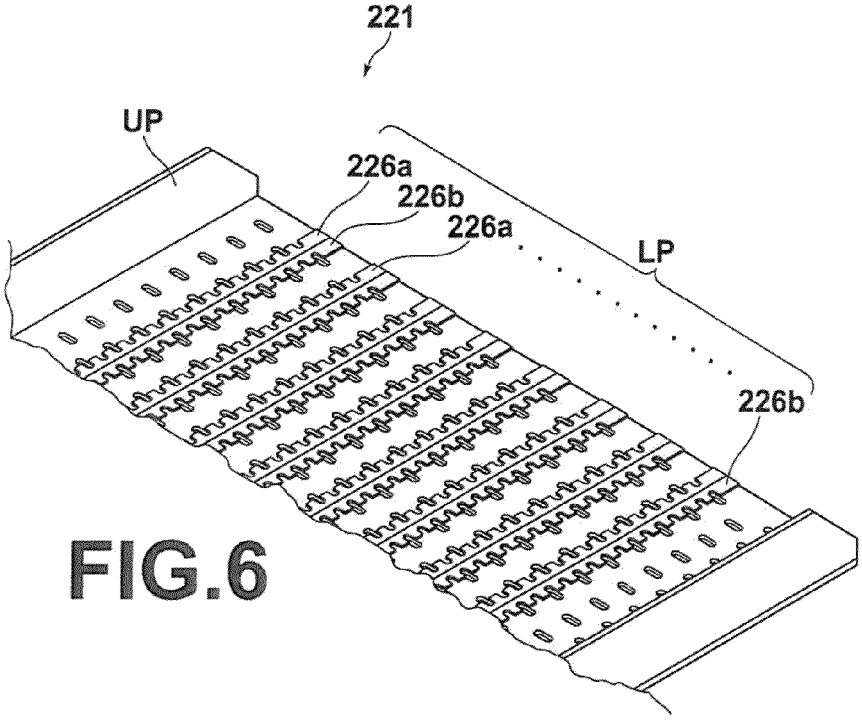
FIG. 6 is a perspective view of the platen viewed from below.

FIG. 4 is a plan view of the platen 221, FIG. 5 is a perspective view of the platen 221 viewed from above, and FIG. 6 is a perspective view of the platen 221 viewed from below. In FIG. 4, a projection position of each inkjet head 211 is indicated by the dashed line. As illustrated, the platen 221 is a plate member, and has a double-layer structure including an upper platen UP and a lower platen LP.

As shown in FIG. 4, the upper platen UP includes a plurality of platen holes 221*a* formed in a staggered pattern in a range where the belt holes 222 of the platen belt 222 pass. Further, depressions 221*b*, which communicate with the platen holes 221*a*, are formed in the surface of the upper platen UP.

The lower platen LP includes a plurality of plate members 226*a* and 226*b* extending in the main-scanning direction, which are disposed to be able to slide in the sub-scanning direction on the lower surface of the upper platen around a position immediately below the inkjet head 211. Each plate member 226*a*, 226*b* has a mechanism for shifting the position thereof on the lower surface of the upper platen with a driving means, such as a motor or a solenoid. The position is controlled by the control section 50.

Figure 7A:
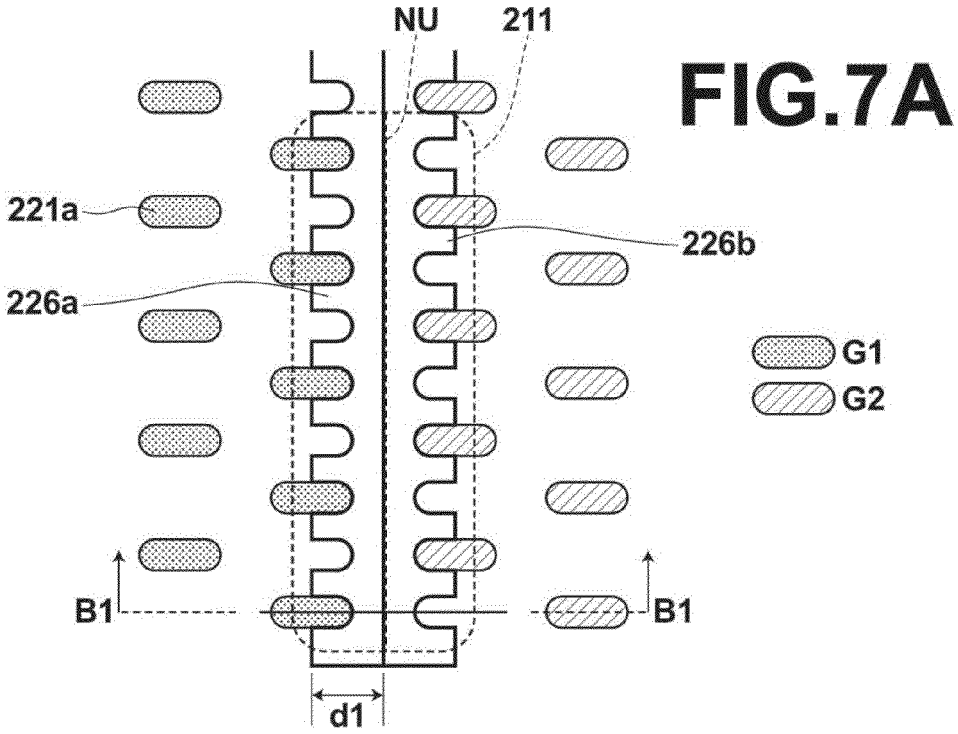
FIG. 7A is a diagram illustrating the position of a lower platen when a head gap is small.
Figure 7B:
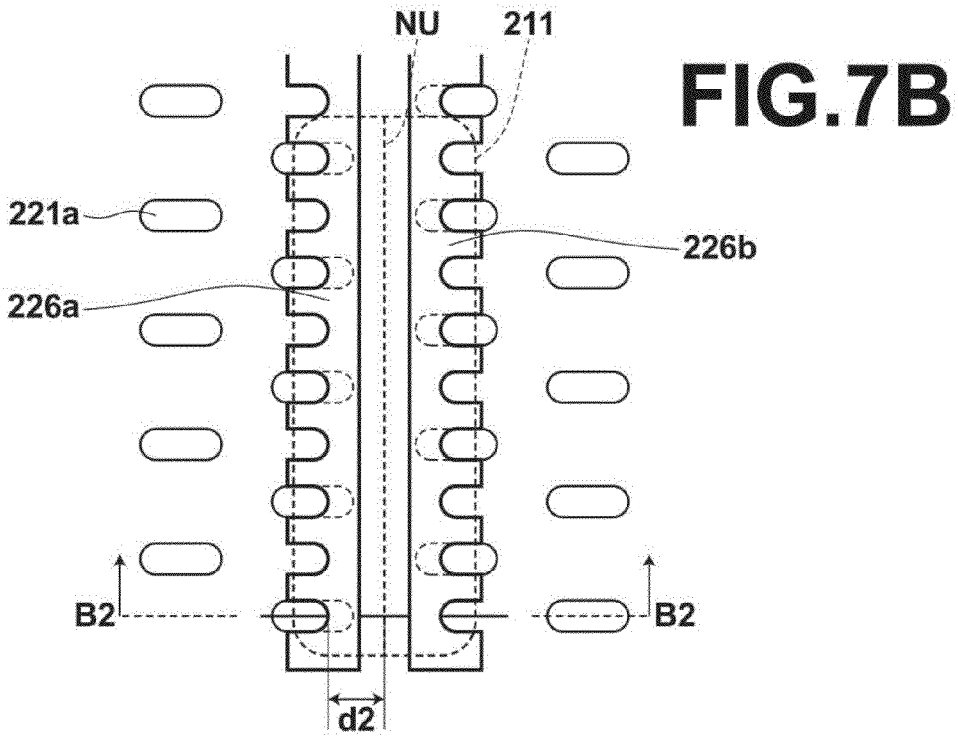
FIG. 7B is a diagram illustrating the position of the lower platen when the head gap is large.

The control section 50 retrieves the setting information of the head gap stored in the memory, and controls the position of each plate member 226*a*, 226*b* based on the setting information. FIG. 7A is a bottom view showing the positions of the plate members 226*a* and 226*b* relative to the platen holes 221*a* of the upper platen when the head gap G is small, FIG. 7B is a bottom view showing the positions of the plate members 226*a* and 226*b* relative to the platen holes 221*a* of the upper platen when the head gap G is large, FIG. 8A is a sectional view taken along line B1-B1 in FIG. 7A, and FIG. 8B is a sectional view taken along line B2-B2 in FIG. 7B.

Figure 8A:
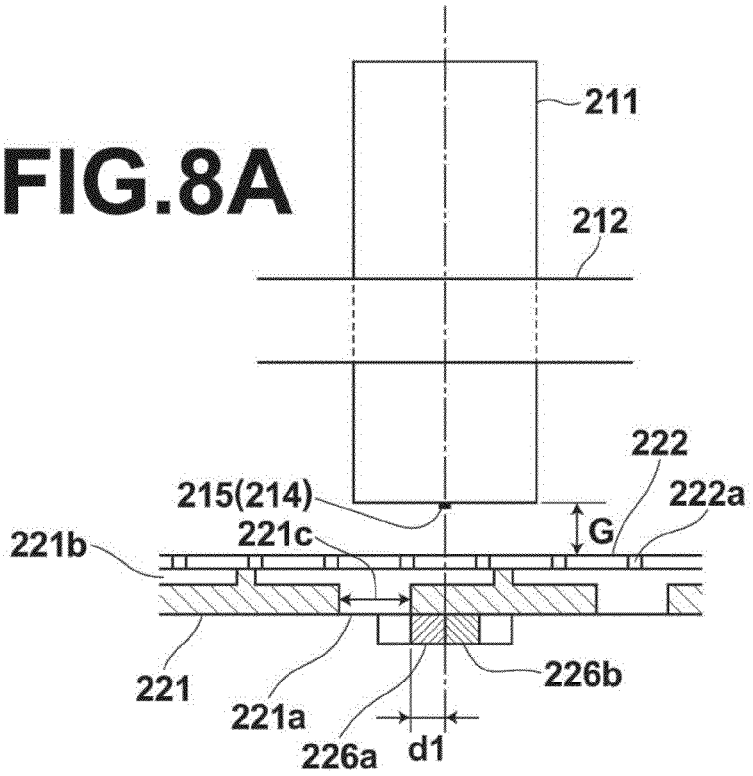
FIG. 8A is a sectional view taken along line B1-B1 in FIG. 7A.
Figure 8B:
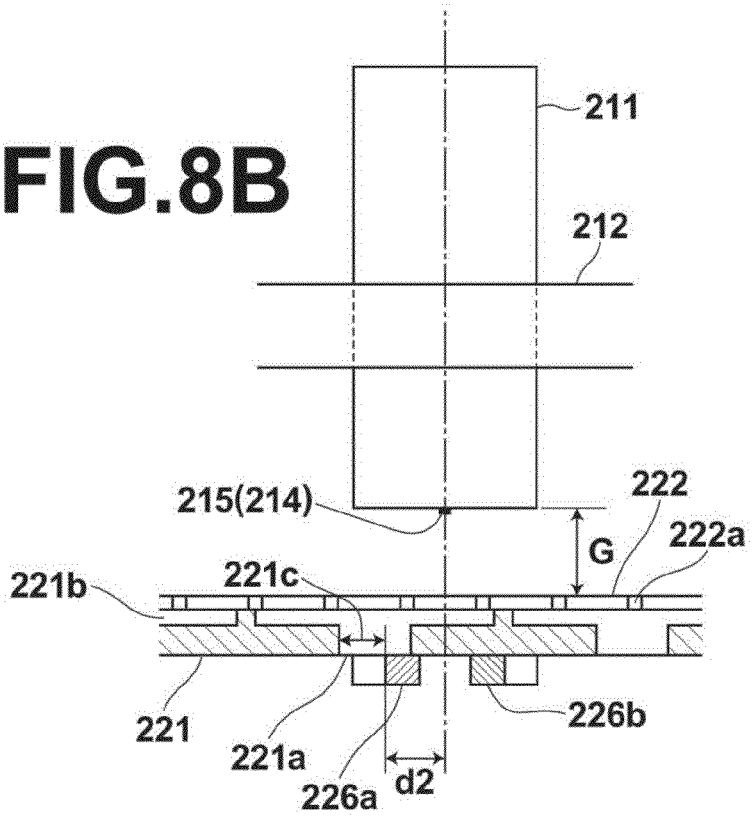
FIG. 8B is a sectional view taken along line B2-B2 in FIG. 7B.

As shown in FIGS. 7A and 8A, when the head gap G is smaller than a predetermined threshold, the control section 50 shifts the plate members 226*a* and 226*b* toward a position NU immediately below the inkjet nozzles 214 such that the plate members 226*a* and 226*b* do not overlap with the platen holes of the upper platen. In contrast, as shown in FIG. 7B and FIG. 8B, when the head gap G exceeds the predetermined threshold, the control section 50 shifts the plate members 226*a* and 226*b* away from the position NU immediately below the inkjet nozzles 214 such that the plate members 226*a* and 226*b* partially close the platen holes 221*a* of the upper platen.

Therefore, when the head gap G is large, the size of the through holes 221*c* passing through the upper platen UP and the lower platen LP in the vicinity of the inkjet nozzles 214 is reduced, and a distance between the position NU immediately below the inkjet nozzles 214 and edges of the through holes 221*c* nearer to the inkjet nozzles 214 is increased from d1 to d2 (d2>d1). It should be noted that, in this embodiment, as shown in FIG. 7A, the positions and the size of the through holes are adjusted with respect to substantially a half of the through holes in a through hole group G1 positioned upstream in the conveyance direction of the recording medium from and nearest to the position NU immediately below the inkjet nozzles 214 and a through hole group G2 positioned downstream in the conveyance direction from and nearest to the position NU.

The control section 50 may control the positions of the plate members 226*a* and 226*b* in a stepwise manner based on determination as to whether or not the head gap G exceeds a predetermined threshold, or may control the positions of the plate members 226*a* and 226*b* in a continuous manner depending on the magnitude of the head gap G. The mechanism for shifting the position of the lower platen LP, the driving means and the control section 50 form size adjusting means and position adjusting means of the invention.

The platen belt 222 includes a plurality of belt holes 222*a* formed in a staggered pattern. When the fan 225 provides a negative pressure in the space below the platen 221, a suction force is generated at each through hole 221*c*. It should be noted that the space below the platen 221 is sealed with a frame (not shown).

When the platen belt 222 slides over the platen 221, a suction force is also generated at the belt holes 222*a* passing over the depressions 221*b*. The suction force generated at the belt holes 222*a* is maximized when the belt holes 222*a* pass above the through holes 221*a*.

The leading edge, which is upstream in the sub-scanning direction, of the paper sheet P sent out by the pair of timing rollers 14 is detected by a sensor (not shown), and the paper sheet P is suctioned and held on the platen belt 222 by the belt holes 222*a* to be conveyed. When the paper sheet P passes through the position immediately below the inkjet nozzles 214 at a predetermined speed, each inkjet head 211 ejects ink line by line to form an image on the paper sheet P. It should be noted that timing of the ejection of ink by the head unit 21 and timing of the conveyance of the paper sheet P by the platen unit 22 are controlled by the control section 50.

As described above, according to the inkjet printing apparatus 1 of this embodiment, even when the head gap G is large, the suction force in the vicinity of the inkjet nozzles 214 is reduced by reducing the size of the through holes 221*c* in the vicinity of the inkjet nozzles 214 and shifting the positions of the through holes 221*c* away from the inkjet nozzles 214, thereby reducing the disturbance of streams of air in the vicinity of the inkjet nozzles 214. This can also reduce the contamination with scattered ink mist caused by the disturbance of streams of air in the vicinity of the inkjet nozzles 214.

Next, a second embodiment of the first aspect of the inkjet printing apparatus is described. The inkjet printing apparatus of this embodiment differs from the inkjet printing apparatus 1 in that, when the head gap G is large, only the size of the through holes in the vicinity of the inkjet nozzles 214 is reduced, and the positions of the through holes relative to the inkjet nozzles 214 are not changed. In the following description, the difference from the inkjet printing apparatus 1 is focused, and features that are the same as those in the inkjet printing apparatus 1 are denoted by the same reference symbols and descriptions thereof are omitted.

Figure 9A:
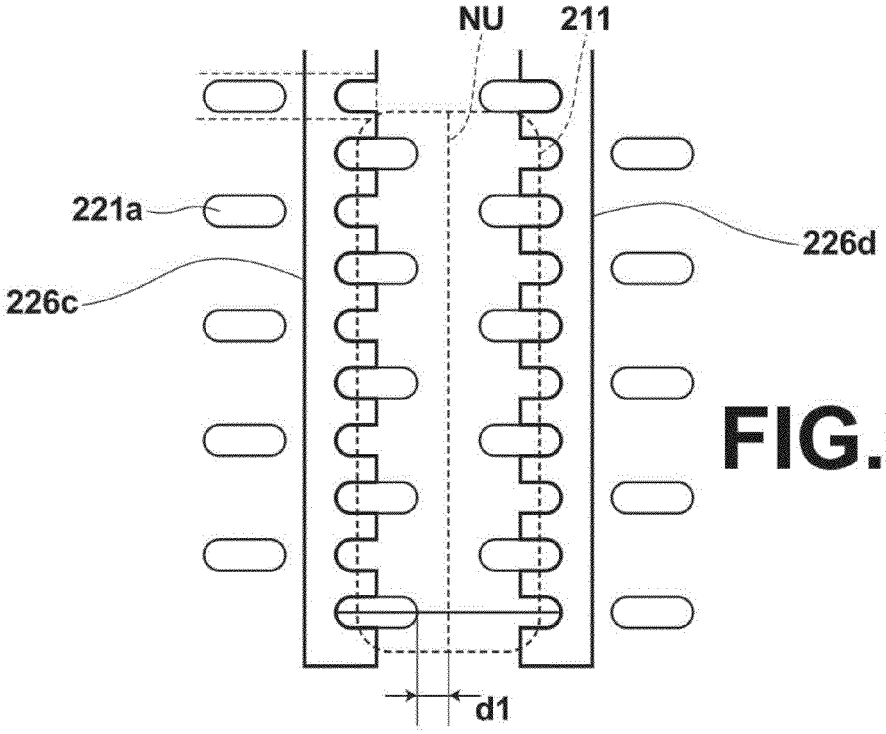
FIG. 9A is another diagram illustrating the position of the lower platen when the head gap is small.
Figure 9B:
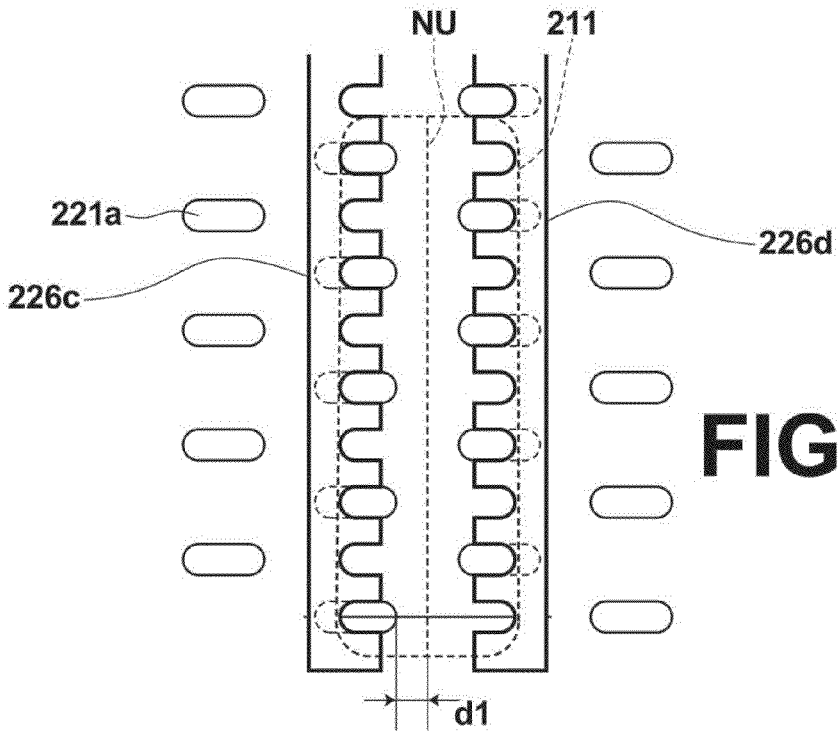
FIG. 9B is another diagram illustrating the position of the lower platen when the head gap is large.

FIG. 9A is a bottom view showing the positions of the plate members 226*c* and 226*d* relative to the platen holes 221*a* of the upper platen when the head gap G is small, and FIG. 9B is a bottom view showing the positions of the plate members 226*c* and 226*d* relative to the platen holes 221*a* of the upper platen when the head gap G is large.

In this embodiment, when the head gap G is smaller than a predetermined threshold, as shown in FIG. 9A, the control section 50 shifts the plate members 226*c* and 226*d* away from the position NU immediately below the inkjet nozzles 214 such that the plate members 226*c* and 226*d* do not overlap with the platen holes of the upper platen. In contrast, when the head gap G exceeds the predetermined threshold, as shown in FIG. 9B, the control section 50 shifts the plate members 226*c* and 226*d* toward the position NU immediately below the inkjet nozzles 214 such that the plate members 226*c* and 226*d* partially close the platen holes 221*a* of the upper platen. Therefore, when the head gap G is large, the size of the through holes passing through the upper platen UP and the lower platen LP in the vicinity of the inkjet nozzles 214 is reduced. This reduces the suction force in the vicinity of the inkjet nozzles 214.

According to the inkjet printing apparatus of this embodiment, even when the head gap G is large, the suction force in the vicinity of the inkjet nozzles 214 is reduced by reducing the size of the through holes in the vicinity of the inkjet nozzles 214, thereby reducing the disturbance of streams of air in the vicinity of the inkjet nozzles 214. This can also reduce the contamination with scattered ink mist caused by the disturbance of streams of air in the vicinity of the inkjet nozzles 214.

Next, an embodiment of a second aspect of the inkjet printing apparatus is described. The inkjet printing apparatus according to this embodiment differs from the inkjet printing apparatus 1 in that, when the head gap G is large, only the positions of the through holes in the vicinity of the inkjet nozzles 214 are shifted away from the inkjet nozzles 214, and the size of the through holes is not changed. In the following description, the difference from the inkjet printing apparatus 1 is focused, and features that are the same as those of the inkjet printing apparatus 1 are denoted by the same reference symbols and descriptions thereof are omitted.

Figure 10A:
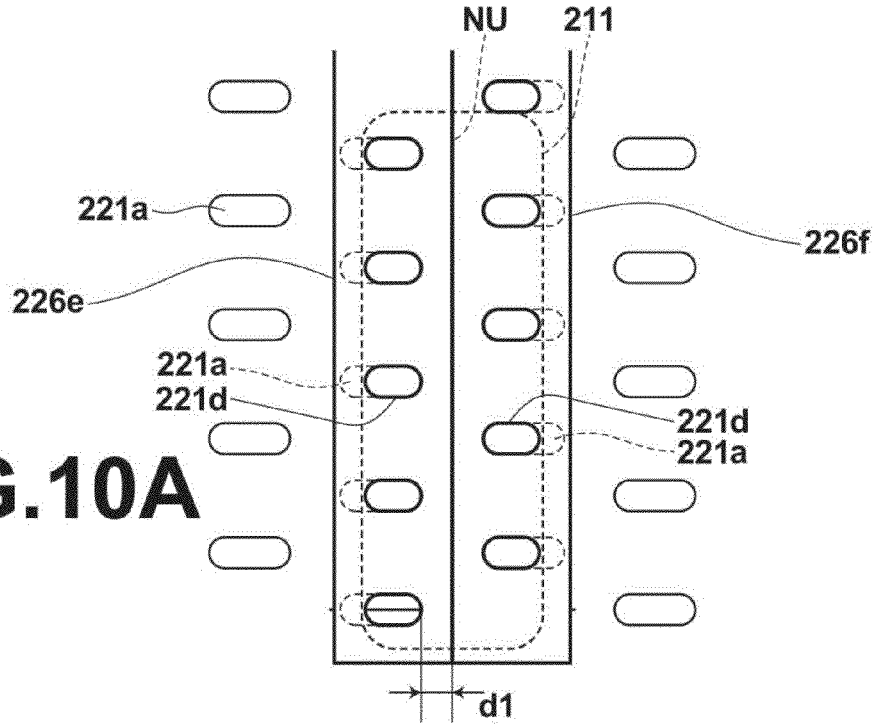
FIG. 10A is yet another diagram illustrating the position of the lower platen when the head gap is small.

FIG. 10A is a bottom view showing the positions of the plate members 226*e* and 226*f* relative to the platen holes 221*a* of the upper platen when the head gap G is small, and FIG. 10A is a bottom view showing the positions of the plate members 226*e* and 226*f* relative to the platen holes 221*a* of the upper platen when the head gap G is large.

Figure 10B:
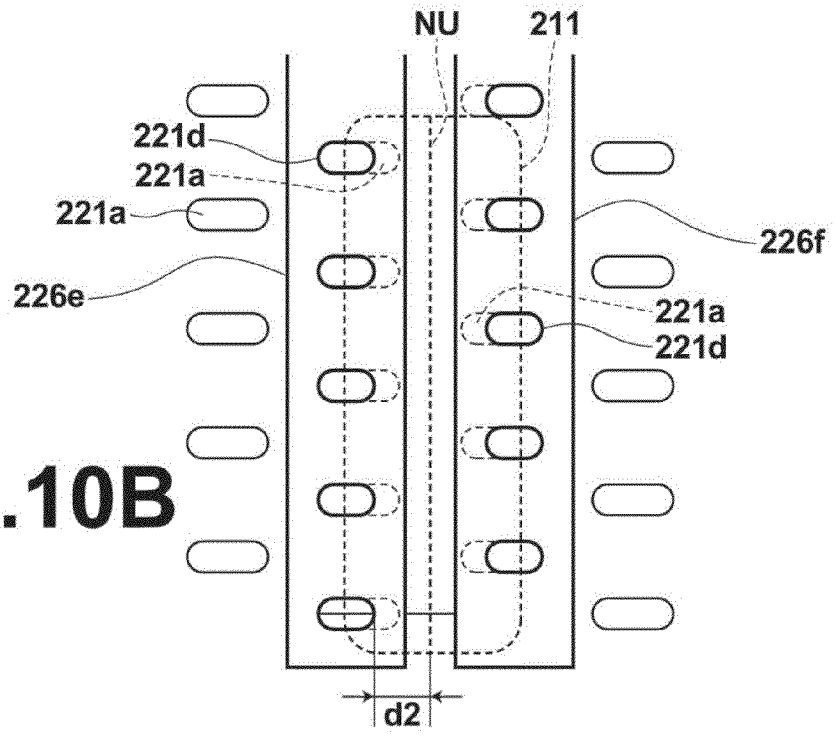
FIG. 10B is yet another diagram illustrating the position of the lower platen when the head gap is large.

In this embodiment, the lower platen includes openings 221*d* having a size smaller than that of the platen holes 221*a* of the upper platen. When the head gap G is smaller than a predetermined threshold, as shown in FIG. 10A, the control section 50 shifts the plate members 226*e* and 226*f* toward the position NU immediately below the inkjet nozzles 214 within a range where the openings 221*d* overlap with the platen holes 221*a* without changing the size of the open areas. In contrast, when the head gap G exceeds the predetermined threshold, as shown in FIG. 10B, the control section 50 shifts the plate members 226*e* and 226*f* away from the position NU immediately below the inkjet nozzles 214 within the range where the openings 221*d* overlap with the platen holes 221*a* without changing the size of the open areas.

Therefore, when the head gap G is large, a distance between the position NU immediately below the inkjet nozzles 214 and edges, which are nearer to the inkjet nozzles 214, of the through holes passing through the upper platen UP and the lower platen LP in the vicinity of the inkjet nozzles 214 is increased form d1 to d2 (d2>d1). This reduces the suction force in the vicinity of the inkjet nozzles 214.

According to the inkjet printing apparatus of this embodiment, even when the head gap G is large, the suction force in the vicinity of the inkjet nozzles 214 is reduced by shifting the positions of the through holes, which are in the vicinity of the inkjet nozzles 214, away from the inkjet nozzles 214, thereby reducing the disturbance of streams of air in the vicinity of the inkjet nozzles 214. This can also reduce the contamination with scattered ink mist caused by the disturbance of streams of air in the vicinity of the inkjet nozzles 214.

It should be noted that, although the positions and the size of the through holes are adjusted with respect to substantially a half of the through holes in the through hole groups, which includes the through holes positioned upstream in the conveyance direction of the recording medium from and nearest to the positions corresponding to the inkjet nozzles 214 in a plan view and the through holes positioned downstream in the conveyance direction from and nearest to the positions corresponding to the inkjet nozzles 214 in the plan view, in the cases described in the above-described embodiments, this is not intended to limit the invention. The positions and the size of the through holes may be adjusted with respect to at least one, optionally 50 percent or more, or further optionally 80 percent or more of the through holes in the through hole groups.

Next, an embodiment of a third aspect of the inkjet printing apparatus is described. The inkjet printing apparatus according to this embodiment differs from the inkjet printing apparatus 1 in that, in the case where the paper sheet P is an envelope, the head gap G is set depending on the width of the envelope in the main-scanning direction, and opening and closing of the through holes in the platen are adjusted depending on the set head gap G. In the following description, the difference from the inkjet printing apparatus 1 is focused, and features that are the same as those of the inkjet printing apparatus 1 are denoted by the same reference symbols and descriptions thereof are omitted.

Figure 11:
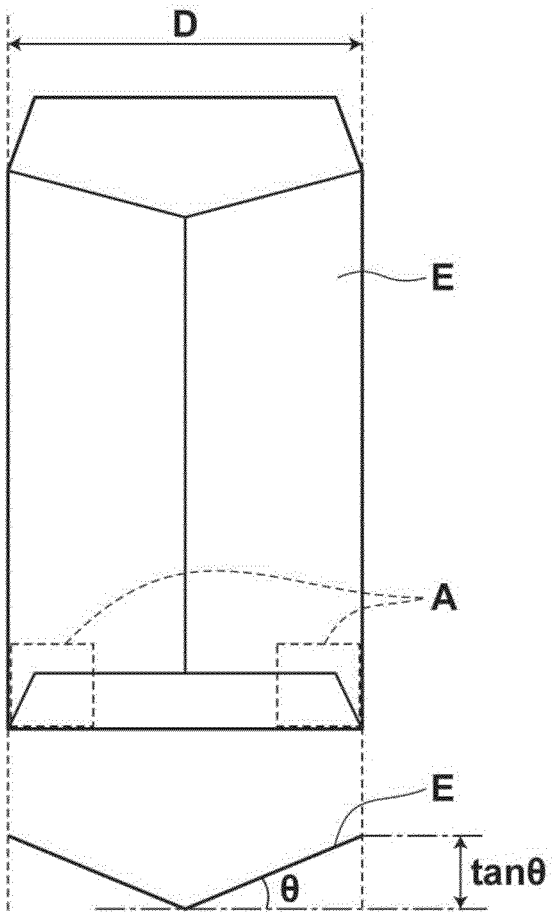
FIG. 11 is a diagram for explaining how the head gap is set depending on the width of an envelope.
Figure 12A:
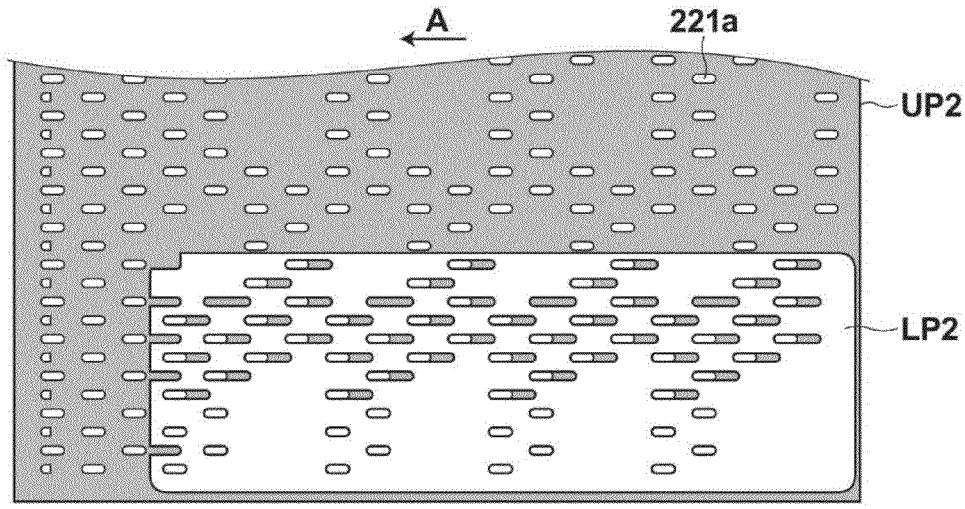
FIG. 12A is a bottom view illustrating a default state of the platen.
Figure 12B:
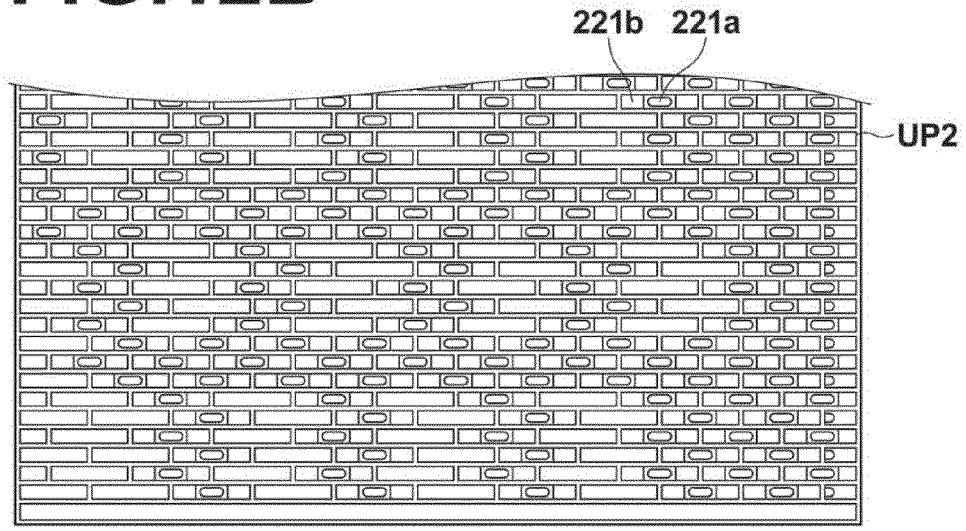
FIG. 12B is a plan view illustrating the default state of the platen.
Figure 13A:
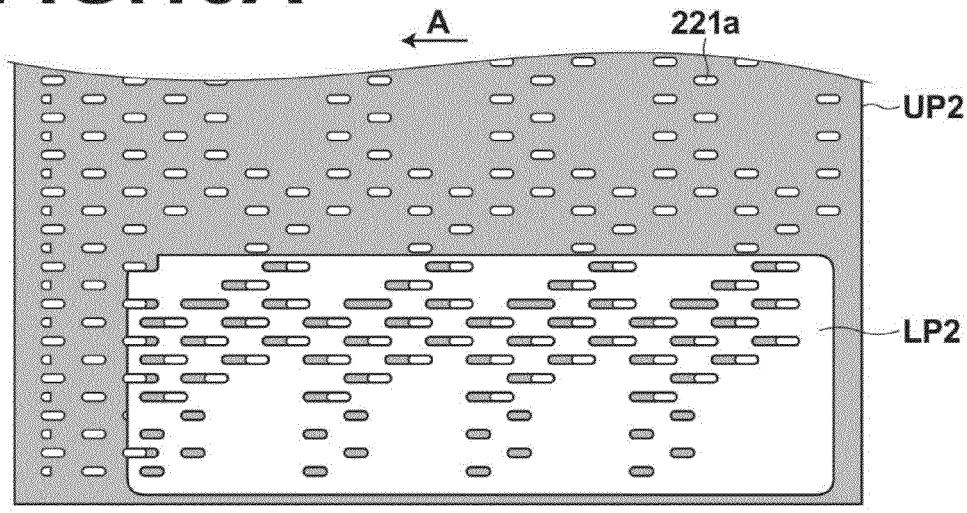
FIG. 13A is a bottom view illustrating a state of the platen when the head gap is large.
Figure 13B:
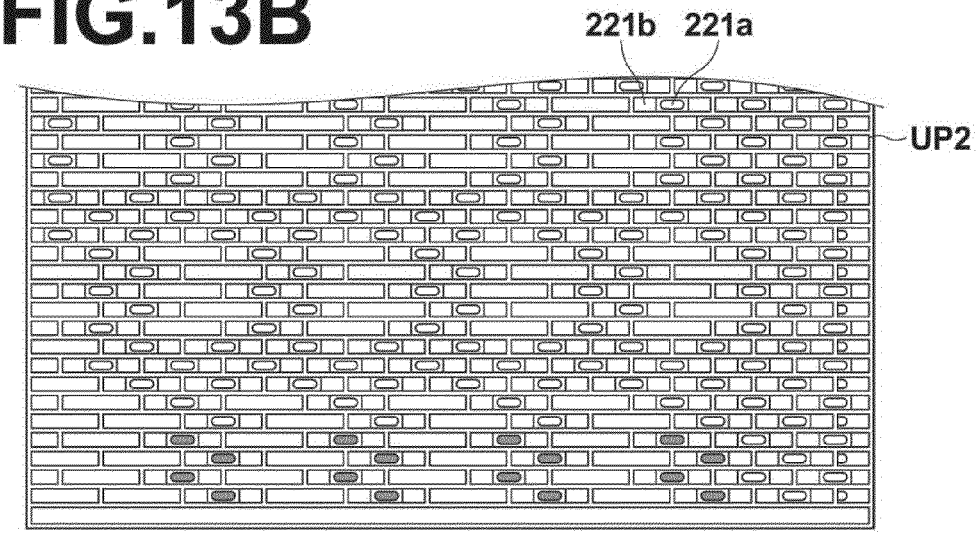
FIG. 13B is a plan view illustrating the state of the platen when the head gap is large.
Figure 14A:
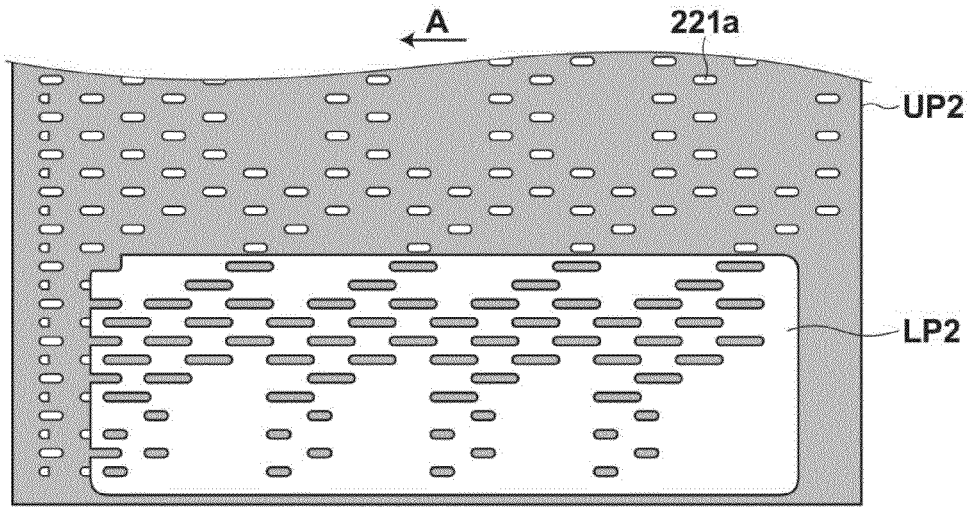
FIG. 14A is a bottom view illustrating a state of the platen when the head gap is small.
Figure 14B:
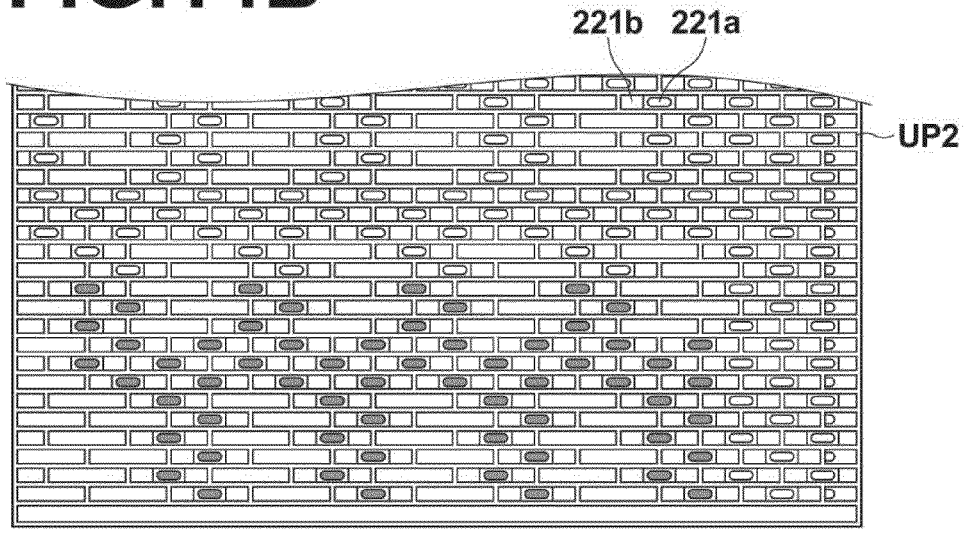
FIG. 14B is a plan view illustrating the state of the platen when the head gap is small.

In this embodiment, first, the width in the main-scanning direction of the paper sheet P fed from the paper feed section 10 is measured and obtained with a paper sheet detecting device, such as an optical sensor, disposed at the paper feed section 10 or on the paper feed path 12. Alternatively, the width of the paper sheet P may be inputted by the user via the control panel of the inkjet printing apparatus. Information of the thus obtained width of the paper sheet P is stored in the memory of the inkjet printing apparatus. Then, the control section 50 retrieves the information of the width D of the paper sheet P stored in the memory, and determines whether or not the paper sheet P is an envelope based on the information. If it is determined that the paper sheet P is an envelope, then, the head gap G is calculated and set according to equation (1) below:

$$G = \alpha \times \frac{D}{2} \times \tan\theta, \tag{1}$$

wherein $\alpha$ is a correction factor depending on the basis weight, and $\theta$ is an angle, by which opposite ends A along the short side direction of an envelope E are raised from the surface of the conveyer belt while the envelope E is suctioned and conveyed, as shown at the lower part in FIG. 11. Since the widths of standard size envelopes are known, it can be determined that the paper sheet P is an envelope if the obtained width is equal to any of the widths of the standard size envelopes. The width in the main-scanning direction of the envelope refers to the length of the envelope along the short side direction, as shown at the upper part in FIG. 11.

Table 1 below shows values of the head gap G set for different widths D of envelopes according to equation (1) when $\alpha$=1 and $\theta$=2°. As shown in Table 1, a larger head gap G is set for a larger width D of the envelope.

TABLE 1

| Type of Envelope | Width of Envelope | Head Gap |
|---|---|---|
| Kaku 0 | 287 | 5.0 |
| Kaku 1 | 270 | 4.7 |
| Kaku 2 | 240 | 4.2 |
| Kaku 3 | 216 | 3.8 |
| Kaku 4 | 197 | 3.4 |
| Kaku 5 | 190 | 3.3 |
| Kaku 6 | 162 | 2.8 |
| Kaku 7 | 142 | 2.5 |

TABLE 1-continued

| Type of Envelope | Width of Envelope | Head Gap |
|---|---|---|
| Kaku 8 | 119 | 2.1 |
| Chou 1 | 142 | 2.5 |
| Chou 2 | 119 | 2.1 |
| Chou 3 | 120 | 2.1 |
| Chou 4 | 90 | 1.6 |

Further, in this embodiment, the platen 221 includes an upper platen UP2 and a lower platen LP2, and the control section 50 controls the position of the lower platen LP2 relative to the upper platen UP2 based on the setting information of the head gap G, as shown in FIGS. 12A to 14B. Specifically, in the case where the paper sheet P is an envelope and the head gap G exceeds 3 mm, the position of the lower platen LP2 relative to the upper platen UP is shifted from the default state of the platen 221, as shown in the bottom view in FIG. 12A and the plan view in FIG. 12B, by a predetermined amount in the direction A, as shown in the bottom view in FIG. 13A and the plan view in FIG. 13B. In contrast, in the case where the head gap G does not exceed 3 mm, the position of the lower platen LP2 relative to the upper platen UP is further shifted in the direction A, as shown in the bottom view in FIG. 14A and the plan view in FIG. 14B.

Therefore, in the case where the paper sheet P is an envelope, the lower platen LP2 partially closes the openings of the platen holes 221 which are formed within a predetermined range from the ends of the upper platen UP in the main-scanning direction, thereby limiting generation of the suction force at the position. Further, in the case where the head gap G exceeds 3 mm, the range where generation of the suction force is limited has a smaller width in the main-scanning direction than that in the case where the head gap G does not exceed 3 mm, and therefore an area on the conveyer belt 222 where the suction force is generated has a larger width in the main-scanning direction.

According to the inkjet printing apparatus of this embodiment, in the case where the paper sheet P is an envelope, the head gap G is adjusted such that a larger head gap G is provided for a larger width of the envelope in the main-scanning direction, and when the head gap G is large, opening and closing of the through holes are adjusted such that the area where the suction force is generated has a larger width in the main-scanning direction. Therefore, the width of the area on the conveyer belt 222 where the suction force is generated can be appropriately controlled depending on the width of the envelope, thereby reducing the disturbance of streams of air in the vicinity of the inkjet nozzles.

What is claimed is:

1. An inkjet printing apparatus for carrying out printing by ejecting ink on a recording medium, the apparatus comprising:

a conveyer belt with a plurality of belt holes formed therein, the conveyer belt suctioning and conveying the recording medium with a negative pressure acting on the belt holes;

a platen with a plurality of through holes formed therein, the platen slidably supporting the conveyer belt;

pressure reducing means for generating the negative pressure on a side of the platen opposite from a side thereof supporting the conveyer belt;

at least one inkjet nozzle disposed to face the platen, the inkjet nozzle ejecting the ink on the recording medium being conveyed by the conveyer belt;

distance changing means for changing a distance between the inkjet nozzle and a surface of the conveyer belt on which the recording medium is suctioned; and size adjusting means for adjusting a size of the through holes based on the distance, wherein, when the distance is large, the size adjusting means adjusts the size of at least one through hole in a through hole group such that the size of the at least one through hole is reduced, the through hole group including the through holes positioned upstream in a conveyance direction of the recording medium from and nearest to each position corresponding to the at least one inkjet nozzle in a plan view and the through holes positioned downstream in the conveyance direction from and nearest to each position corresponding to the at least one inkjet nozzle in the plan view.

2. The inkjet printing apparatus as claimed in claim 1, wherein, when the distance is large, the size adjusting means adjusts the size of at least a half of the through holes in the through hole group such that the size of the at least half of the through holes is reduced.

3. The inkjet printing apparatus as claimed in claim 1, wherein the platen comprises an upper platen and a lower platen, and the size adjusting means adjusts the size of the through holes by shifting a position of the lower platen relative to the upper platen.

4. The inkjet printing apparatus as claimed in claim 1, further comprising position adjusting means for adjusting relative positions of the through holes relative to the inkjet nozzle based on the distance, wherein, when the distance is large, the position adjusting means adjusts the relative position of at least one through hole in the through hole group relative to the inkjet nozzle such that the position of the at least one through hole is shifted away from the inkjet nozzle.

5. An inkjet printing apparatus for carrying out printing by ejecting ink on a recording medium, the apparatus comprising:

a conveyer belt with a plurality of belt holes formed therein, the conveyer belt suctioning and conveying the recording medium with a negative pressure acting on the belt holes;

a platen with a plurality of through holes formed therein, the platen slidably supporting the conveyer belt;

pressure reducing means for generating the negative pressure on a side of the platen opposite from a side thereof supporting the conveyer belt;

at least one inkjet nozzle disposed to face the platen, the inkjet nozzle ejecting the ink on the recording medium being conveyed by the conveyer belt;

distance changing means for changing a distance between the inkjet nozzle and a surface of the conveyer belt on which the recording medium is suctioned; and position adjusting means for adjusting relative positions of the through holes relative to the inkjet nozzle based on the distance, wherein, when the distance is large, the position adjusting means adjusts the relative position of at least one through hole in a through hole group relative to the inkjet nozzle such that the position of the at least one through hole is shifted away from the inkjet nozzle, the through hole group including the through holes positioned upstream in a conveyance direction of the recording medium from and nearest to each position corresponding to the at least one inkjet nozzle in a plan view and the through holes positioned downstream in the conveyance direction from and nearest to each position corresponding to the at least one inkjet nozzle in the plan view.

6. The inkjet printing apparatus as claimed in claim 5, wherein, when the distance is large, the position adjusting means adjusts the relative positions of at least a half of the through holes in the through hole group relative to the inkjet nozzle such that the positions of the at least half of through holes are shifted away from the inkjet nozzle.

7. The inkjet printing apparatus as claimed in claim 5, wherein the platen comprises an upper platen and a lower platen, and the position adjusting means adjusts the relative position by shifting the position of the lower platen relative to the upper platen.

8. An inkjet printing apparatus for carrying out printing by ejecting ink on a recording medium, the apparatus comprising:

a conveyer belt with a plurality of belt holes formed therein, the conveyer belt suctioning and conveying the recording medium with a suction force generated at the belt holes;

a platen with a plurality of through holes formed therein, the platen slidably supporting the conveyer belt;

pressure reducing means for generating a negative pressure on a side of the platen opposite from a side thereof supporting the conveyer belt to generate the suction force at the belt holes via the through holes;

at least one inkjet nozzle disposed to face the platen, the inkjet nozzle ejecting the ink on the recording medium being conveyed by the conveyer belt;

distance adjusting means for adjusting, in a case where the recording medium is an envelope, a distance between the inkjet nozzle and a surface of the conveyer belt on which the recording medium is suctioned such that a larger distance between the inkjet nozzle and the surface of the conveyer belt is provided for a larger width of the envelope in a direction perpendicular to a conveyance direction of the envelope; and opening/closing adjusting means for adjusting, in the case where the recording medium is an envelope and when the distance is large, opening and closing of the through holes such that an area where the suction force is generated has a large width in the direction perpendicular to the conveyance direction.

* * * * *